United States Patent [19]

Schoenberg et al.

[11] 4,421,800

[45] Dec. 20, 1983

[54] SPRAYING APPARATUS

[75] Inventors: Steve Schoenberg, Clifton Park; David G. Ellis, Ballston Lake, both of N.Y.

[73] Assignee: Digitronics Inventionering Corp., Clifton Park, N.Y.

[21] Appl. No.: 345,106

[22] Filed: Feb. 2, 1982

[51] Int. Cl.[3] ..... B05D 1/02; B05B 1/16; B05B 12/00

[52] U.S. Cl. ..... 427/424; 118/677; 118/679; 118/680; 118/684; 118/314; 118/323; 118/324

[58] Field of Search ..... 427/424; 118/677, 679, 118/680, 669, 681, 314, 684, 323, 324

[56] References Cited

U.S. PATENT DOCUMENTS

| | | | |
|---|---|---|---|
| 2,754,795 | 7/1956 | Enslle | 118/323 X |
| 3,593,308 | 7/1971 | Fagan | 118/679 X |
| 3,646,521 | 2/1972 | Porter | 118/679 X |
| 3,739,742 | 6/1973 | Racz et al. | 118/684 |
| 4,151,808 | 5/1979 | Beck et al. | 118/684 |

FOREIGN PATENT DOCUMENTS

| | | | |
|---|---|---|---|
| 3014500 | 10/1981 | Fed. Rep. of Germany | 118/679 |

*Primary Examiner*—Shrive P. Beck
*Attorney, Agent, or Firm*—Howard L. Rose

[57] ABSTRACT

Apparatus for spraying at least one finishing substance onto a material (such as leather) passing a plurality of spray booths having sprayer devices associated therewith. Various inputs relating to (a) sprayer device position, (b) the location and area of material on a moving conveyor carrying the material, (c) conveyor movement, and (d) other related inputs are directed to a single computer unit which communicates command signals which effect the closing of selected normally open valves corresponding to respective sprayer devices. The apparatus provides for limited overspray, accounts for delay following a computer command signal due to valve response time, and include various corrections related to embodiments having sprayer devices which move in nonrectilinear paths. A rotary transformer coupling for improving communication between the computer unit and the valves is provided in rotating sprayer arrangements which have a plurality of sprayer devices, each of which follows a circular path.

43 Claims, 18 Drawing Figures

| U | Part No. | +5 | GND | J1 | FUNCTION | | FUNCTION |
|---|---|---|---|---|---|---|---|
| 1 | 74LS138 | 16 | 8 | | | | |
| 2 | 14040 | 16 | 8 | | | | |
| 3 | 74LS393 | 14 | 7 | | | | |
| 4 | 74LS191 | 16 | 8 | | | | |
| 5 | 74LS139 | 16 | 8 | | | | |
| 6 | 74LS00 | 14 | 7 | 1 | +5 | A | +5 |
| 7 | 74LS04 | 14 | 7 | 2 | DBO | B | CAZ |
| 8 | 74LS00 | 14 | 7 | 3 | DBI | C | PAO |
| 9 | 6802P | 8,35 | 1,21 | 4 | DB2 | D | PA1 |
| 10 | 74LS245 | 20 | 10 | 5 | DB3 | E | PA2 |
| 11 | RAM IV | 24 | 12 | 6 | DB4 | F | PA3 |
| 12 | RAM III | 24 | 12 | 7 | DB5 | H | PA4 |
| 13 | RAM II | 24 | 12 | 8 | DB6 | J | PA5 |
| 14 | RAM I | 24 | 12 | 9 | DB7 | K | PA6 |
| 15 | EPROM I | 24 | 12 | 10 | R/WB | L | PA7 |
| 16 | EPROM II | 24 | 12 | 11 | AOB | M | PBO |
| 17 | EPROM III | 24 | 12 | 12 | AIB | N | PBI |
| 18 | EPROM IV | 24 | 12 | 13 | AZB | P | PB2 |
| 19 | 74LS138 | 16 | 8 | 14 | ESO | R | PB3 |
| 20 | 6821P | 20 | 1 | 15 | ESI | S | PB4 |
| 21 | 6850P | 12 | 1 | 16 | ES2 | T | PB5 |
| 22 | 74LS245 | 20 | 10 | 17 | ES3 | U | PB6 |
| 23 | 3486 | 16 | 8 | 18 | ES4 | V | PB7 |
| 24 | 1488 | -- | 7 | 19 | ES5 | W | CBI |
| 25 | 504 | | | 20 | +15 | X | +15 |
| 26 | | | | 21 | -15 | Y | -15 |
| 27 | | | | 22 | GND | Z | GND |
| 28 | | | | | | | |

FIGURE 11(c)

| FUNCTION | J12 -16 (connects to sprayer devices) | J22-J26 (I/O BONDS) | FUNCTION | J22 - J26 | J21 (CPU) | J20 |
|---|---|---|---|---|---|---|
| IN # 4 D3 | 1 | 12 | Ao | 1 | 11 | PIN |
| IN # 3 D2 | 2 | 13 | A1 | 2 | 12 | TO |
| +24 V IN | 3 | 14 | A2 | 3 | 13 | PIN |
| +24 V IN | 4 | 14 | R/W | 4 | 10 | 2-21, |
| GND | 5 | 15 | ESO | J22-5 | 14 | B-Y |
| GND | 6 | 15 | ESI | J23-5 | 15 | |
| IN # 1 DO | 7 | 16 | ES2 | J24-5 | 16 | |
| IN # 2 D1 | 8 | 17 | ES3 | J25-5 | 17 | |
| OUT# 4 D3 | 9 | 18 | ES4 | J26-5 | 18 | |
| OUT# 3 D2 | 10 | 19 | D3 | 6 | 5 | |
| OUT# 2 D1 | 11 | 20 | DO | 7 | 2 | |
| OUT# 1 DO | 12 | 21 | D1 | 8 | 3 | |
| OVERRIDE | 13 | 22 | D2 | 9 | 4 | |
| | | | +5DC | 10 | 1,A | 1,A |
| | | | +5 RETURN | 11 | 22,Z | 22,Z |
| BOARD # | J | J | FUNCTION | J11 | | |
| 2 | 22 | J12 | +5 DC | 1 | | |
| 3 | 23 | J13 | +5 RETURN | 2 | | |
| 4 | 24 | J14 | CHASSIS GND | 3 | | |
| 5 | 25 | J15 | GND | 4 | | |
| 6 | 26 | J16 | +24 DC | 5 | | |

BACKPLANE BOARD # 1

JOINS ALL CIRCUIT BOARDS

FIGURE 12

INTERRUPT ROUTINE

INITIALIZATION AND IDLE TASK

SPROCKET-TASK

ADVANCE BELT TASK

SPRAYING APPARATUS

FIELD OF THE INVENTION

The present invention relates to apparatus for spraying a finishing substance onto a material (such as leather, hides or skins) on a conveyor.

TECHNOLOGICAL CONTEXT OF THE INVENTION

It is known in the garment industry, particularly but not exclusively in the leather finishing trade, to apply finishing substance to a material as it moves along on a continuous conveyor. These finishing substances, such as dye and lacquer, are applied by spray guns of several different types passing over the material in a path at least in part transverse to the direction of the conveyor motion. Generally, such materials include the hides or skins of animals, of both mammals and reptiles, which have been suitably preserved and processed for use in the manufacturing of various articles such as clothing and the like.

The conveyor is typically a horizontal continuous medium made of metal wire or plastic fibers, that are caused to move longitudinally. The material is placed upon the conveyor spread out flat so that its surface is exposed for the application of finishing substances. The material then travels on the conveyor from one work station, or spray booth, to another passing under spraying apparatus and drying devices, in order to leave a coating of various substances upon the surface of the material. The number of spraying and drying stations along the line varies with the needs of the process. Also the distance between the processing booths may vary greatly with the particular process. It is not unknown to have as many as four spraying booths in series on a single conveyor line. One or more of these spray booths may be in operation at any one time.

The spraying apparatus itself may be of several different types. A first type of spraying machine consists of a reciprocating arm traveling back and forth across the conveyor. There are several types of reciprocating spray machines in current use. One type is a style of machine called in the trade a "one arm bandit". This machine consists of an arm with two ends, the arm pivotting about a stationary point therebetween. The first end of the arm is connected to a control rod which is caused to move in a reciprocating manner, the second end of the arm travelling back and forth across the conveyor. This reciprocating motion can be produced in different ways, but the most common is to link this control rod to a pivot point located at a radial distance from the axis of rotation of a cam wheel. The cam wheel rotates by means of an electric motor drive. As the cam wheel rotates, the control rod travels through a locus of points. This, in turn, causes the first end of the arm to travel back and forth. Where the second end is much further from the stationary pivot point than is the first end, the second end travels many feet while the first end may move less than one foot. The linkages and motor drive are set so that the end of the arm travels a distance greater than the width of the material to be sprayed, and at such a speed that the successive passage of the arm over the material gives a good coverage of finishing material at the selected conveyor velocity. One or more sprayer devices are located relatively near the first end of the arm. A plurality of sprayer devices allows more finishing material to be applied on each pass of the arm.

It should be noted that the sprayer devices on an arm travel through curved trajectories and the path of each sprayer device has a different radius of curvature. It is important to the finishing process that the spray patterns of the sprayer devices and the speed of travel of these arms be adjustable so that the particular finish result may be obtained.

The second type of spray machine is rotary in nature. This type of machine has a number of sprayer devices located radially outward on a carousel type of device. As the spray machine rotates, the sprayer devices are caused to travel around in a circle, over the conveyor surface. Each sprayer device on the machine travels through the same trajectory as the others. The movement of the conveyor causes each pass of the guns successively to apply finish to progressive parallel trajectories on the material. Overlapping of these trajectories causes a uniform finish to be applied to the material. In commercially used implimentations of this type of machine, between four and sixteen sprayer devices are located on one rotating sprayer arrangement or assembly. The continuous rotary motion of this machine demands that any finishing material, air, or electrical signal fed to the carousel be supplied through rotating joints and seals. This has created numerous problems.

In the past, various sprayer devices have been employed. A common element has been that the finishing substance be ejected from a nozzle under pressure. By placing a valve in the path of pressurizing medium, the sprayer devices are caused to turn on and off upon command. By causing this valving action to be directly or indirectly controlled by an electrical signal, an electronic controller can be used to command the sprayer devices to turn on and off.

Sprayer machines of these types have been set forth in various prior patents.

U.S. Pat. No. 3,060,734 by Tilley discloses apparatus for determining the area and thickness of an article moving in a direction transverse to a series of photoelectric cells which are selectively energized when the article passes therebefore. The output of the Tilley apparatus is a read out of the area of the article on a display. Use of the output as a control signal is nowhere suggested in the patent.

Giraudo in U.S. Pat. No. 2,714,870 teaches apparatus for spray varnishing a hide or skin on a moving conveyor wherein a sprayer has an optical device associated therewith, both the sprayer and optical device focusing at "substantially coinciding points." When the optical device senses the presence of the hide or skin, the associated sprayer provides a jet of varnish. According to this patent, the spray valve of the sprayer is "left closed, preventing the sprayer from delivering colour or dye" if a beam from the optical device is reflected and is opened if the beam is intercepted. If the apparatus in U.S. Pat. No. 2,714,870 malfunctions by failing to provide inputs, a hide or skin will proceed along the conveyor and will not be sprayed. The use of a back-up system is severely limited, the spray being switched off by the malfunction. Further, the apparatus in the reference required an optical device for each sprayer and a mirror large enough to cover substantially the entire working area of the sprayer or sprayers. A problem suggested by this prior art apparatus relates to the possibility of spray being inadvertently applied to either the mirror or the beam source of the optical device. In either case, the apparatus may misinterpret the lack of beam reflection and deliver spray although no skin or hide is present.

A previous disclosure by Giraudo in U.S. Pat. No. 2,565,655 does not include some of the disadvantages relating to his later case. In the earlier Giraudo case, a hide or skin on a conveyor passes by a light cell which reciprocates transverse to the direction of movement of the skin or hide on the conveyor. The light cell, directed toward an area on the conveyor, indicates when a skin or hide is detected at the area and perforates a paper tape when this condition exists. Coupled to the light cell are sequential sprayers which are spaced at fixed intervals L and which reciprocate transversely in synchrony with the movement of the light cell. Sprayer operation is controlled by sequential sensors which successively read the paper tape at fixed intervals l. When a sensor detects a perforation in the tape, a corresponding sprayer is triggered on. In the accordance with this apparatus, the ratio of the intervals L and l must be the same as the rate of feed of the conveyor and of the paper tape, respectively, if proper spraying at sequential sprayers is to be achieved. This prior apparatus thus includes structural restrictions and synchronization requirements which limit the adaptability of the invention. Specifically, if the timing of successive sprays is significant, the apparatus of U.S. Pat. No. 2,565,655 may be inadequate where such apparatus cannot, for example, spray at times corresponding to fractional intervals nL (where n is not a whole number). Further, while this Giraudo apparatus may eliminate the possible problems of spray being inadvertently applied to the light cell, this prior apparatus requires a perforation sensor for each sprayer, a plurality of paper tape rollers, and paper tape which, as noted in the specification therein, necessitates the inclusion of a safety contact for discontinuing spraying in case of paper tear. As in the later Giraudo case, U.S. Pat. No. 2,565,655 teaches a normally closed apparatus wherein failure results in hides and skins not being sprayed.

Namenyi-Katz, in U.S. Pat. No. 2,029,774, teaches apparatus wherein an article to be sprayed passes sensors and its shape is magnetically recorded on a medium disposed along the periphery of a rotating drum. Namenyi-Katz improves on the previous Giraudo systems by using a magnetic recording medium rather than punched paper, however various disadvantages attach to the system of U.S. Pat. No. 2,029,774. First, as in U.S. Pat. No. 2,565,655, speed of rotation of the drum and the speed of which the article moves must be synchronized. Second, reproducing heads which provide actuating signals to respective sprayers must reciprocate or rotate over the surface of the drum in a pattern similar to and in synchronism with the movement of the sprayers. Accordingly, any change in the relative spacing of the sprayers or movement of the sprayers must be accounted for by a corresponding adjustment of the reciprocating heads. Again, such sprayer in this prior system, is normally off and is actuated when the edge of the material passes a particular sensor or sensors; thus, if there is a system malfunction no spray is provided.

Namenyi-Katz teaches a rotating sprayer assembly. Therein a conventional slip-ring coupling is provided between the rotating sprayer assembly and a stationary shaft which carries electrical control signals which are to be communicated to the rotating sprayer assembly or, more specifically, the sprayer device valves. This coupling, of course, subject to wear and experience has taught that sealing such an arrangement against the adverse effects of a spray substance infiltrating the slip-ring assembly is a severe problem. Others have addressed this problem by mounting the slip-rings above the spray machine along the axis of sprayer rotation. In such devices, wires carrying the control signals pass down the center of an air pipe through a rotating pneumatic seal. Means are then required to pass the wires out of the air pipe without losing the pressure seal. In addition, the presence of the wires restricts the flow of air in the pipe. Thus, the use of a slip-ring for coupling a rotating spray embodiment has been found deficient for various reasons.

SUMMARY OF THE INVENTION

The present invention represents a generational step ahead in the field of automatic sprayers. Rather than paper tape or a magnetic drum, the invention contemplates inputs to a computer which control the selected actuation of each of a plurality of sprayers at various spray booths along the length of a conveyor, the conveyor carrying a material (such as a hide or skin) which is to be sprayed with one or a plurality of substances at the various booths. In accordance with the invention, various sprayer devices at a plurality of spray booths are controllable by a single computer unit. Further, various prior art synchronization requirements are obviated by use of appropriately located sensors to determine conveyor position, material location on the conveyor, and the positions of the sprayer devices and supply signals indicative of these factors to the single computer unit that in turn generates and deliveres appropriate signals to each sprayer device in each spray booth. The present invention, in other words, does not employ a paper roll or magnetic drum which must move synchronously with the conveyor and each sprayer device does not require a respective sensing element which moves relative to a magnetic drum in simulation of the movement of each such sprayer device (as taught by Namenyi-Katz).

The single computer unit in the invention includes an INTERRUPT ROUTINE which determines whether spraying from each of the sprayer devices should be inhibited or not. In accordance with the INTERRUPT ROUTINE, a SPROCKET TASK is provided which measures conveyor speed; and ADVANCE BELT TASK is provided which reads optical sensors and determines location and area (i.e. the size and shape) on the conveyor of material to be sprayed; and a combined INITIALIZATION AND IDLE TASK is provided which initializes apparatus parameters, updates conveyor position, calculates sprayer device velocities, and updates sprayer device valve control information. In accordance with the INTERRUPT ROUTINE, the tasks are assigned priorities, the SPROCKET TASK being the highest and the INITIALIZATION AND IDLE TASK being lowest. Further, each spray booth is examined and the positions of each sprayer device therein is updated. A determination is made if a sprayer device is over material to be sprayed. If not, the valve to such sprayer device is closed.

In this regard it is noted that the present invention maintains its sprayer devices in a "normally open" (NO) state such that spraying is not precluded in the event of system malfunction. The computer unit provides commands which close the spray valves. Accordingly, the present invention works as it did before installation of the computer unit if such computer unit fails to provide commands. In this way, the system can continue operating even during installation of the computer unit and even if the computer unit malfunctions. The present invention thus permits the prior system to operate as a back-up if desired.

According to the present apparatus, it is noted that various novel features can be realized without the necessity of reconfiguring the system. For example, overspray may be provided and controlled such that spray extends beyond the material for a short distance in order to assure the uniform spraying of all the material. Similarly, variations in (a) distance between sprayer devices in a spray booth, (b) distances between spray booths, and (c) distances between spray booths and the transverse optical sensors which detect the dimensions of the material to be sprayed are readily accounted for.

Also, in the case of a "one arm bandit" arrangement, the sprayer devices follow an arc, rather than rectilinear path transverse to the movement of the material. By using the arm length and conveyor width information, the present apparatus can compensate for "droop" (i.e. variation in distance of sprayer device from the optical sensors as the arm reciprocates) resulting from the arc path. Similar compensation for a rotating sprayer arrangement which also includes droop during its pass over material may be provided as well.

Still further, the apparatus may compensate for delay between the time a spray command or control signal is sent and when given the sprayer device actually sprays. The delay compensation feature, as well as the droop compensation feature and distance variation feature, can be communicated to the computer unit by simple settings such as thumbwheels.

It is noted that the present invention improves on various prior spray systems which have required that a spray machine be exactly centered. The computer unit of the present invention obviates the need to unbolt and move a spray machine which is not centered.

In accordance with the invention, the spraying of a finishing substance, such as dye or lacquer or the like, may be provided to hide or skin material without unnecessary waste while, at the same time, assuring that no material moves along the conveyor without being sprayed. In this regard, the invention avoids the expense of waste removal, decreases ventillation requirements and costs, and alleviates problems occurring when a spray substance is inadvertently applied to a sensor.

In addition to being computer-controlled, the present invention practically eliminates the problems caused by a spray substance infiltrating the coupling between sprayer device valves and computer-generated control signal input lines. Rather than employing slip-rings, the present apparatus communicates power and/or spray command information via a transformer coupling. Specifically two coils having a common axis are provided, one coil being coupled to the computer unit and the other being coupled to valves. The coil coupled to the valves rotates while the coil coupled to the computer remains stationary. Both coils are wrapped around a pneumatic service pipe, the inside of which is kept pressurized. A rotary seal encompasses the pipe. With the present invention, no wires are provided within the pneumatic service pipe (to obstruct air flow) and no slip-rings which are subject to wear and spray infiltration are employed.

BRIEF DESCRIPTION OF THE DRAWINGS

(FIG. 3 applies as well to the sprocket and switch of FIG. 2.)

FIG. 12 shows a table illustrating a backplane circuit board which interconnects the I/O boards, CPU board, the sprayer machine, and boards relating to the optical sensors.

DESCRIPTION OF THE INVENTION

1. General Description

Figure 1:
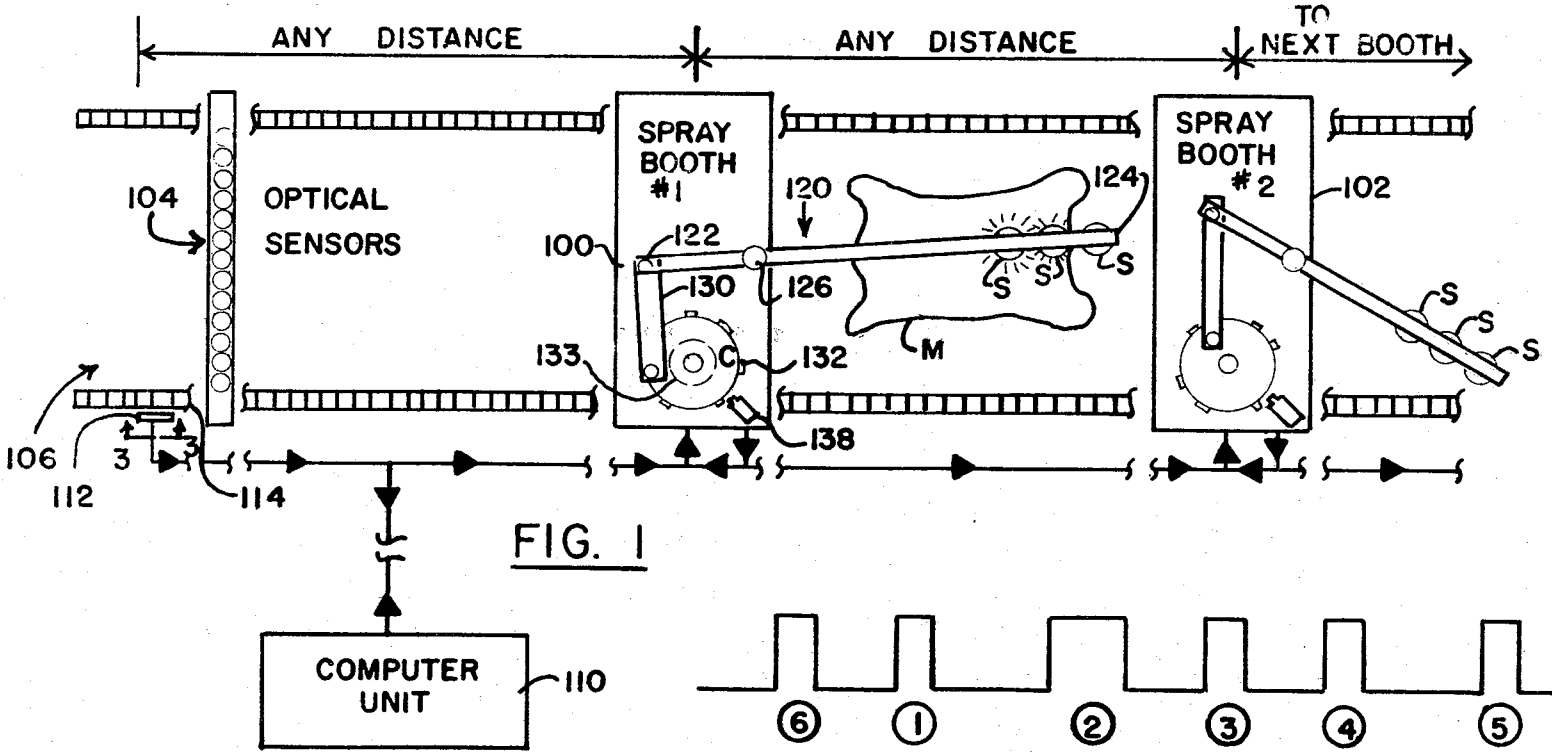
FIG. 1 is a top view illustrating a plurality of one arm bandit spraying arrangements controlled by a single computer unit in accordance with the invention.
Figure 5:
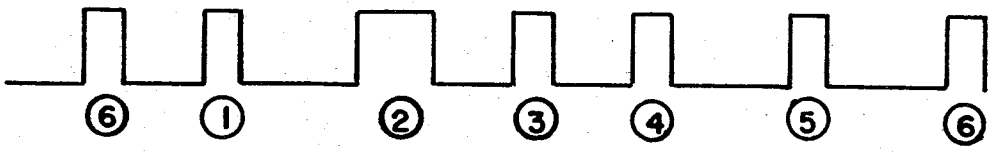
FIG. 5 illustrates the signal produced by the proximity switch 138 as the cam wheel 132 rotates.
Figure 2:
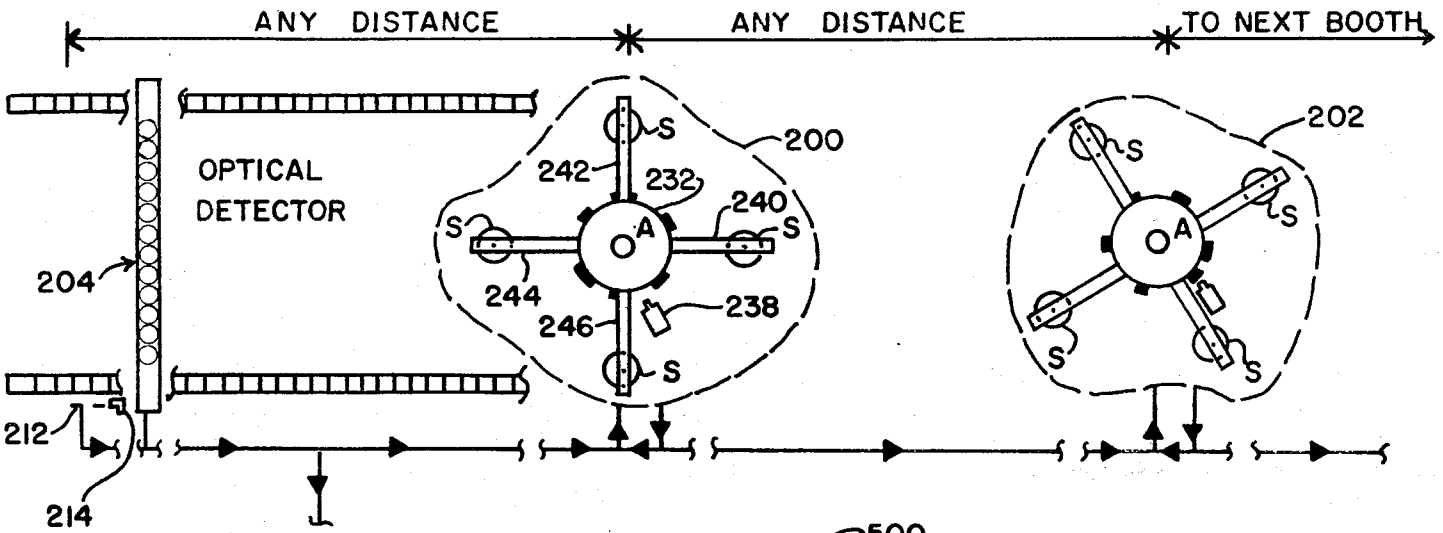
FIG. 2 is a top view illustrating a plurality of rotating sprayer arrangements controlled by a single computer unit in accordance with the invention.

Referring to FIGS. 1 and 2, the present invention is illustrated in two embodiments. FIG. 1 shows the invention with a "one arm bandit" arrangement of sprayer devices S at a first spray booth 100 and second spray booth 102. FIG. 2 shows a rotating arrangement of sprayer devices S, each sprayer device S in FIG. 2 following a circular path centered about an axis A at a first booth 200 and A' at a second booth 202.

In FIG. 1, a plurality of sensors 104 are shown located at distances before the first spray booth 100. The sensors 104 are shown as optical sensors but may, of course, be other sensors as well. The sensors 104 are disposed transverse to the direction of movement of a conveyor 106 on which material M to be sprayed is carried. That is, the position of the plurality of sensors 104 is such that material (such as leather, hides or skins) must pass under at least some of the sensors 104 prior to being in the trajectory of any of the sprayer device S. Light from above the conveyor 106 illuminates the plurality of sensors 104. As material passes before a sensor, the light beam to such sensor is broken. By interrogating each of the sensors 104, a computer unit 110 determines the width and location of material M on the conveyor 106 as it passes the sensors 104.

Figure 3:
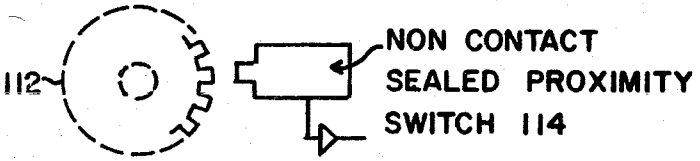
FIG. 3 is a side view detailing the sprocket and switch shown in FIG. 1 along line 3—3.

A chain sprocket 112 is detailed in FIG. 3, the sprocket 112 being connected to the conveyor 106 and rotating at a speed proportional to the speed conveyor travel. Typically this sprocket 112 is fixed to the end roll (not shown) of the conveyor 106, so that its motion is fixed to the end roll. A metal detecting proximity switch 114 is placed near enough to this sprocket 112 that each successive tooth on the sprocket causes the switch 114 to turn "on" as the sprocket 112 rotates. In this manner one electrical pulse is generated each time a tooth passes the proximity switch 114. Since the passage of each tooth past the switch 114 represents an exact displacement of the conveyor 106, the computer unit 110 can track the travel of the conveyor 106 by counting the electronic pulses from the switch 114. The combination of the sensors 104 and the proximity switch 114 on the conveyor 106 give the computer unit 110 precise information concerning the size, shape, position and travel of each piece of material M being carried by the conveyor 106.

The computer unit 110 uses an electronic memory device (see FIG. 11) to store this gathered information. This memory is capable of storing information concerning many individual pieces of material M and tracking these pieces of material M as they proceed along the conveyor 106, over a long distance. All the pieces of material M on an entire conveyor 106 which may be long enough to have a plurality of spray booths therealong) are tracked using a single computer unit 110. That is, a computer for each spray booth is not required.

Figure 4:
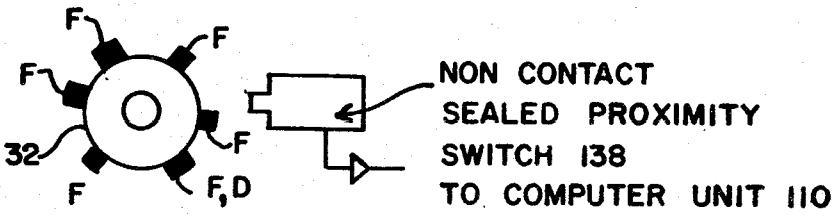
FIG. 4 is a top view detailing the cam wheel and switch in FIG. 1.

The computer unit 110 also receives input information relating to the specific dimensions, location and other details of each sprayer device arrangement on the conveyor 106. In addition a synchronizing device 116, detailed in FIG. 4, is used to provide the computer unit 110 with information regarding the position of the sprayer devices S as they move across the conveyor 106.

In the "one arm bandit" arrangement in spray booth 100, an arm 120 has a first end 122 and a second end 124 having a fixed pivot 126 therebetween. The sprayer devices S are connected to the arm 120 between the pivot 126 and the second end 124, preferably near the second end 124. The first end 122 is pivotally joined to one end of a control rod 130, the other end of the control rod 130 being pivotally connected to a cam wheel 132 which rotates about an axis C. The pivotal connection between the control rod 130 and the cam wheel 132 is displaced a distance from the axis C. As the cam wheel 132 rotates, the control rod 130 reciprocates, causing the arm 120 to oscillate about the pivot 126. The sprayer devices S along the arm 120 thus reciprocate back and forth in an arc path in a relatively transverse path relative to the direction of movement of the conveyor 106. Rotation of the cam wheel 132, it is noted, is imparted by a motor 133 connected to the shaft of the cam wheel 132 (not shown).

As a means of detecting the instantaneous position of the arm 120, six flags, or raised portions, F are located on the rotating cam wheel 132. See FIG. 4. The cam wheel 132 makes one revolution for each complete oscillation of the arm 120. The proper adjustment for the invention is to have the arm 120 overtravel the active area of the conveyor 106 in order to insure uniform coverage. The six sensing flags F mark the position of the arm when: (1) the arm 120 first enters the conveyor traveling to the left, (2) the arm 120 is in the middle of the active area of the conveyor while the arm 120 is traveling to the left, (3) the arm 120 is at the end of the active area on the right end of the conveyor as it is traveling to the left, (4) the arm 120 reenters the right edge of the active area traveling to the right, (5) the arm 120 is at middle of the conveyor 106 as the arm 120 is travelling to the right, and (6) the arm 120 leaves the active area as it is travelling to the right. These position sensing flags are detected by a proximity switch 138 or other means which in turn sends a signal to the computer unit 110. One of the six sensing flags F is made to be substantially wider than the others and is also identified as D. In this manner, the computer unit 110 can distinguish this flag from the others. This unique flag is used to synchronize the computer unit 110 to the motion of the arm 120 by providing one distinct pulse during each repetitive oscillation. These six positional flags F supply sufficient information to enable the computer unit 110 to make appropriate assumptions about the motion of the arm 120 and to compute the instantaneous position of the arm at all times. It should be noted that the flags F on the cam wheel 132 in the "one arm bandit" embodiment are not necessarily located at equal angular intervals, the positions being determined by predetermined positions of the arm 120 relative to the active working area of the conveyor 106. See FIG. 4. While preferable, however this condition is not necessary and can be accounted for by proper programming adjustments to the computer unit 110.

In the "one arm bandit" arrangement, there are many variables that can affect the travel of the arm 120, such as the length of the arm 120, the position of the sprayer device S on the arm 120, the positioning of the driving cam wheel 132, the alignment of the spray booths 100 and 102 to the conveyor 106, and other mechanical factors which cause the motion of the sprayer devices S to be non-linear. The computer unit 110 accounts for these variables by appropriate programming. (See computer listing in Section C.)

Referring to the rotating sprayer embodiment of FIG. 2, sensors 204, a sprocket 212 and related proximity switch 214, a cam wheel 232 and related proximity switch 238, and a computer unit 210 are shown, each of which provides a similar function as in the FIG. 1 embodiment. In the rotating embodiment, however, the arms 240, 242, 244, and 246 of booth 200 traverse a circular path at a constant angular velocity. By obtaining one synchronizing signal at a known angular position, as by a distinctive flag on cam wheel 232, the instantaneous position of all the sprayer devices S on the circular path may be known. Other flags at equal intervals may be provided if desired. The sprayer devices S are normally spaced around the axis A at equal angular intervals and at equal radii from the axis A. Although preferable these conditions are, of course, not necessary.

Although not illustrated, the present invention similarly applies to an arrangement having a sprayer device reciprocating in a rectilinear path transverse to conveyor movement. With this arrangement, two switch positions may be used, thereby obviating the need for a cam wheel. The positions may represent each end of travel of the sprayer device as it reciprocates. The sprayer devices travel beyond the active working area of the conveyor to insure the best results of a uniform coating. One good strategy is to set the switches so that a close valve is given when the sprayer device passes the edge of the active area of the conveyor. Each switch on opposite ends of the travel will give two pieces of information. One signal tells when the sprayer device leaves the active area on one end of the conveyor and the other signal tells when the sprayer device returns to the active area on the return pass in the opposite direction. Assuming constant velocity of the sprayer device while in the active region of the conveyor, these two switches give the computer detailed knowledge of the instantaneous position of the sprayer device.

Regardless of the embodiment, sensors provide inputs to the computer unit which combines the inputs to derive information pertaining to the position of each piece of material and the instantaneous position of each sprayer device in each spray booth along the spray line and to determine when material is presented to each sprayer device. Signals are generated by the computer unit which command a corresponding electrically piloted pneumatic valve for each sprayer device to cease the spraying of a finishing substance whenever a sprayer device is not properly positioned over the material. Such factors as the desire to overspray the edges and the reaction time of the sprayer devices and valves are taken into consideration in these valve command decisions.

In the reciprocating embodiments, the valves may be mounted on the arm (e.g. arm 120) near each sprayer device S. In conventional fashion, electrical and pneumatic service lines are fed to the end of the arm 120 to operate the sprayer devices S of the one arm bandit and the rectilinear embodiments.

Figure 6:
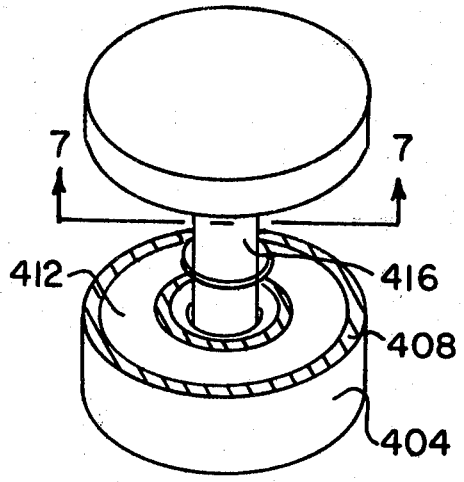
FIG. 6 is a perspective view of a rotary transformer coupling according to the invention.
Figure 7:
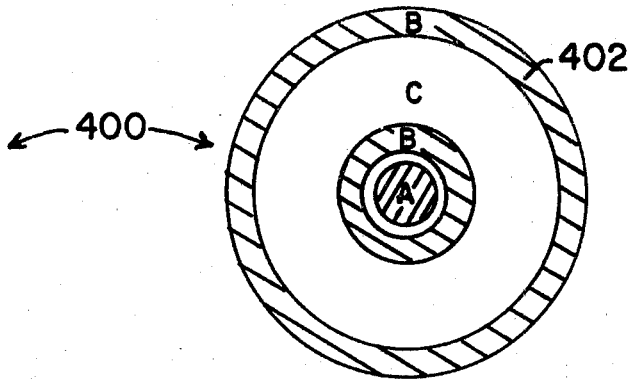
FIG. 7 is a view of FIG. 6 along line 7—7 showing the inside of the ring 402.
Figure 8:
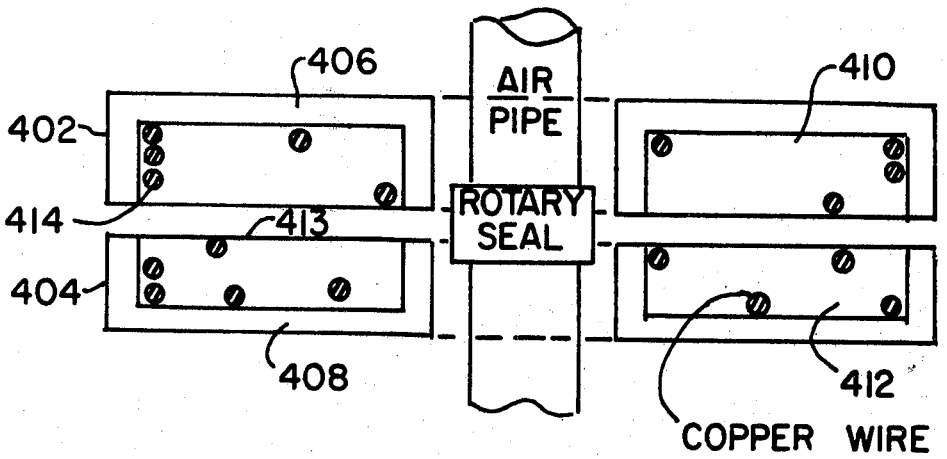
FIG. 8 is a cross-section view of the rotary transformer coupling of FIG. 6.

In the case of the rotating embodiment, however, the continuous motion of the arms 240 to 246 presents a problem since it is necessary to provide a means to insure that service lines will not twist, wind up, and break as the sprayer devices S continue to rotate in one direction. Typically, air and finish material are supplied to the rotating sprayer devices S through pipes along the axis of rotation through the use of rotating seal. Unlike prior inventions which feed electrical communication wires through such pipes, the invention facilitates communication between the computer unit 210 and the valves of the sprayer devices S by employing a novel rotary transformer coupling. Referring to FIG. 6, the rotary transformer coupling 400 is illustrated in perspective. Each of two rings 402 and 404 comprised of iron or steel have u-shaped cross-sections which form shells 406 and 408, respectively. The wire is preferably copper. (See FIGS. 7 and 8). The coil 410 is wound to be concentric with the ring 402 and the coil 412 is wound concentric with the ring 404 within the shell 408. These two coils 410 and 412 are in proximity with each other. The ferrous shells 406 and 408 around the coils 410 and 412, respectively, form a core for a transformer action, so that when an electrical current enters one coil, a current is induced in the other coil. These two transformer rings 402 and 404 are placed around the pneumatic service pipe 416 leading into the sprayer devices in a rotating sprayer embodiment. Coil 412 is fixed so that it is stationary. The other coil 410 is free to rotate with the arms 420 to 426. The two coils 410 and 412 are substantially aligned along a common axis, and in close proximity, but not in physical contact with one another. Various alternatives to the arrangement of FIG. 8 wherein the coils 410 and 412 have equal radii and are spaced apart along the axial direction exist. For example, the coils 410 and 412 may have differing radii and may then be radially spaced apart, one coil encircling the other.

Figure 9:
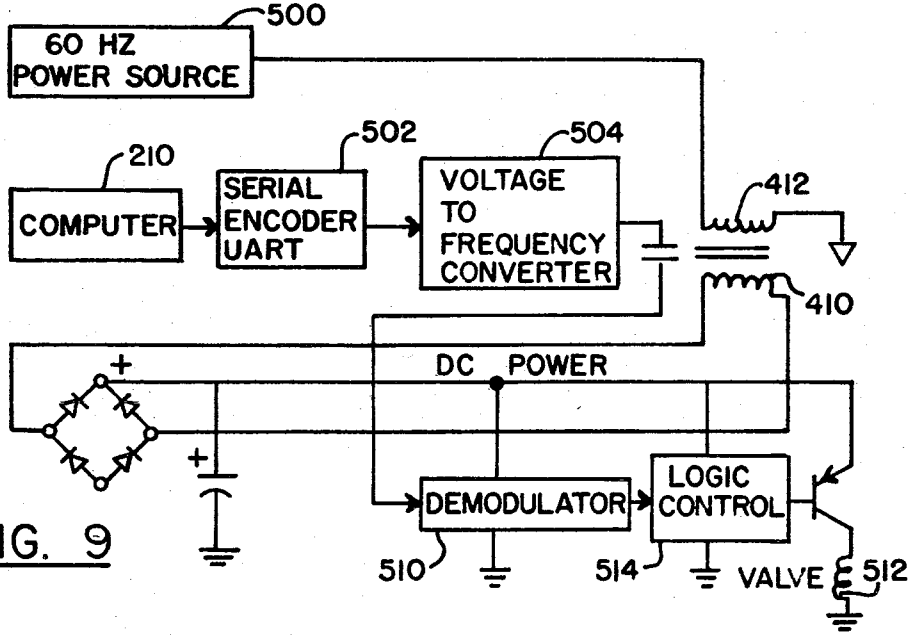
FIG. 9 is a block diagram showing the elements of the rotary transformer coupling.

As seen in FIG. 9, an alternating current is impressed onto the stationary coil 412 to supply power that will be necessary to power the valves. This power may be 24 volts at 60 Hertz or any other suitable voltage from a source 500. Also applied to the stationary coil 412 is a signal carrying intelligence concerning the state of each valve. This command data is generated by the computer unit 210 and may be encoded by an encoder 502 in any suitable manner. One such manner is to encode the data into a serial format and to frequency shift key (FSK) modulate the data onto a higher frequency carrier in a voltage-to-frequency converter 504. This intelligence is coupled through the rotary transformer 400 by impressing the signal onto a flat plate 413 mounted on the inside surface of ring 404. This flat plate must be insulated from the ferrous shell 408. A similar flat plate 414 is mounted to the rotating shell 402. These two plates 413 and 414 are substantially parallel and adjacent to each other. The intelligence signal impressed upon plate 413 is capacitively coupled onto plate 414, and decoded in a demodulator 510. This information is used to command the individual valves 512 to open and close at the appropriate times. A logic control element 514 determines to which valve signals are to be sent, effecting proper valve opening and closing. Power to the rotating assembly is rectified to power the demodulator 510 and logic control 514.

It should be noted that the valves, such as valve 512, are normally open in the FIG. 9 circuit. Commands from the computer unit 210 effect closing of the valves when appropriate. In this way, the present invention may be easily added to an old sprayer system, the old system performing as usual when the present invention is either not yet installed or not receiving command signals from the computer unit 210. Other systems which maintain valves in a normally closed state disallow a previous system to work in conjunction therewith. It should be noted that the valves are conventional pneumatic valves, but are operated in a mode contrary to prior teachings.

The wire in the coils, the sensors which are preferably optical, the proximity switches, and the conveyors are each conventional, although the selected combined use thereof, especially in conjunction with a single computer unit, is unique.

2. Specific Description of the Computer Unit

A. Hardware

Figure 10:
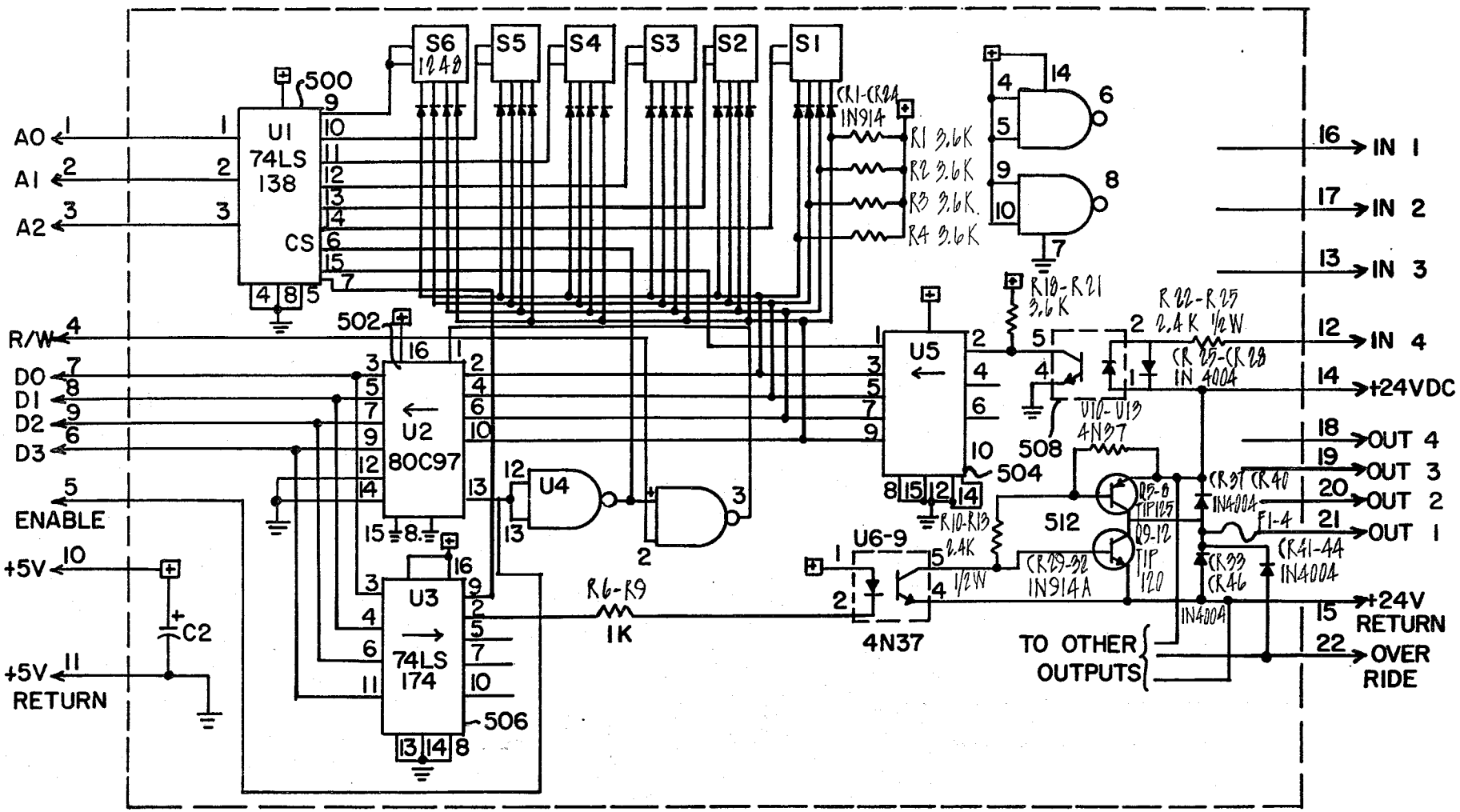
FIG. 10 is a circuit diagram showing one-quarter of an I/O board found in the computer unit of the invention.
Figure 11A:
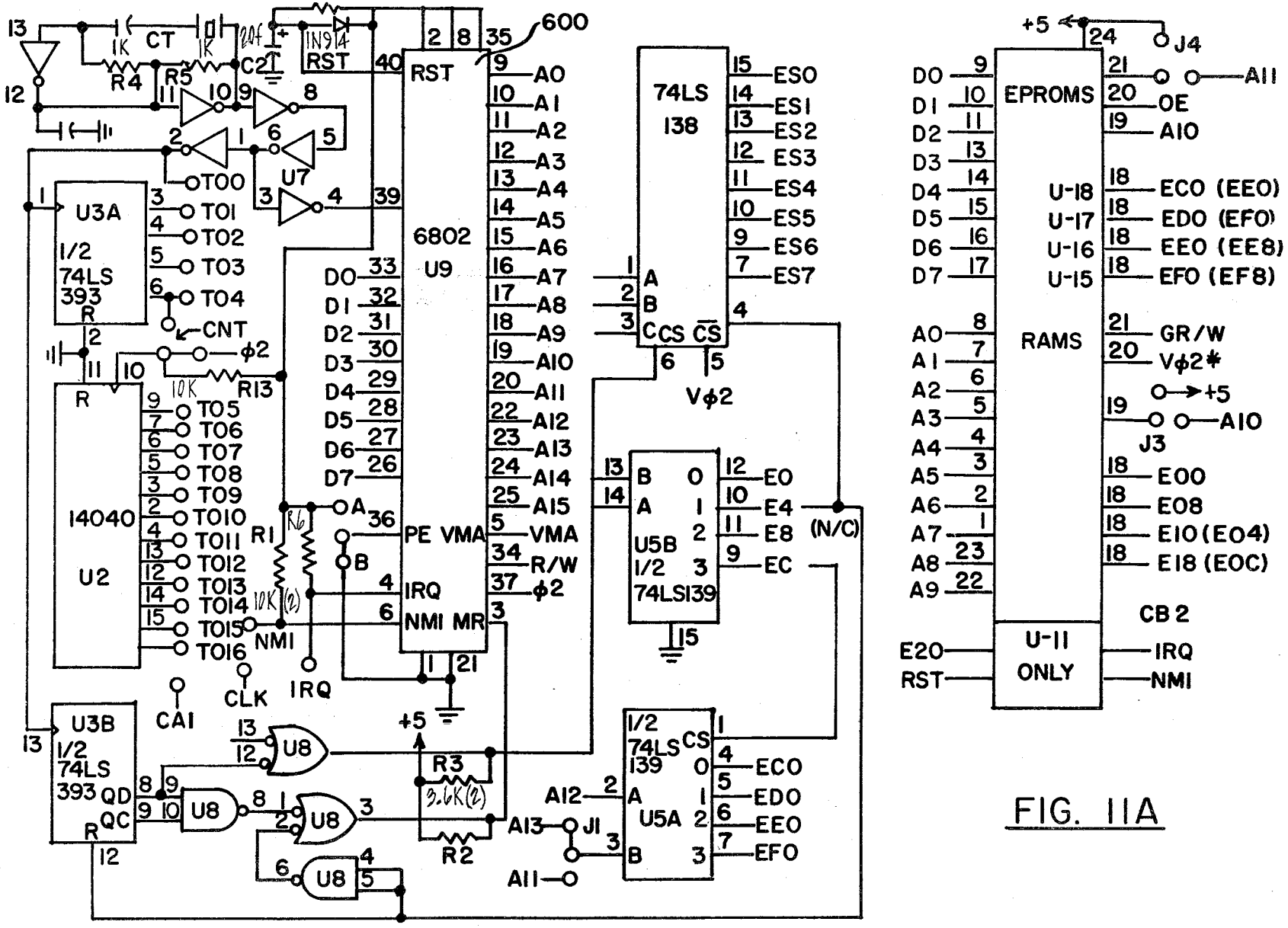
FIG. 11 is a diagram detailing the elements in the CPU board of the invention.
Figure 11B:
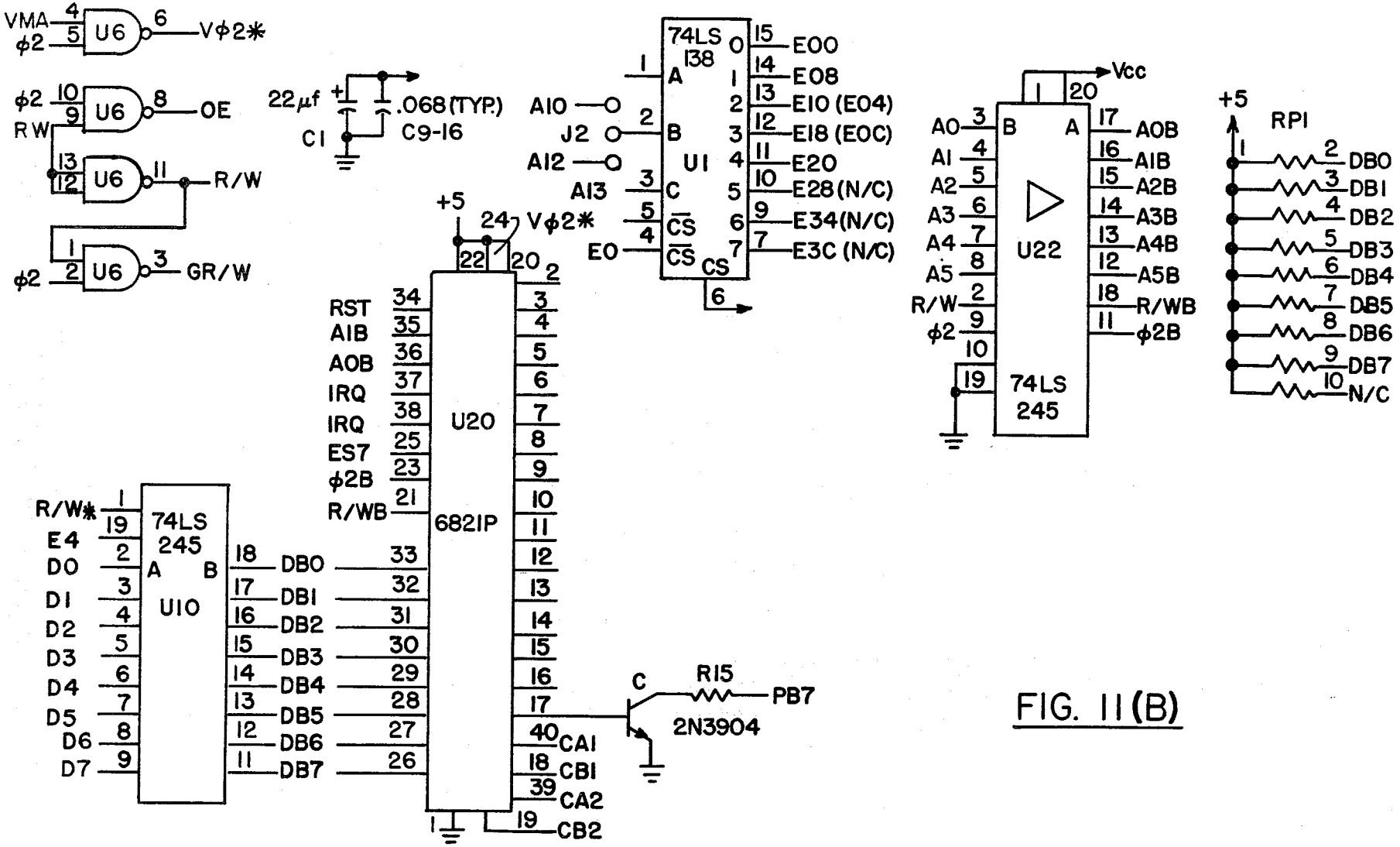
Figure 13A:
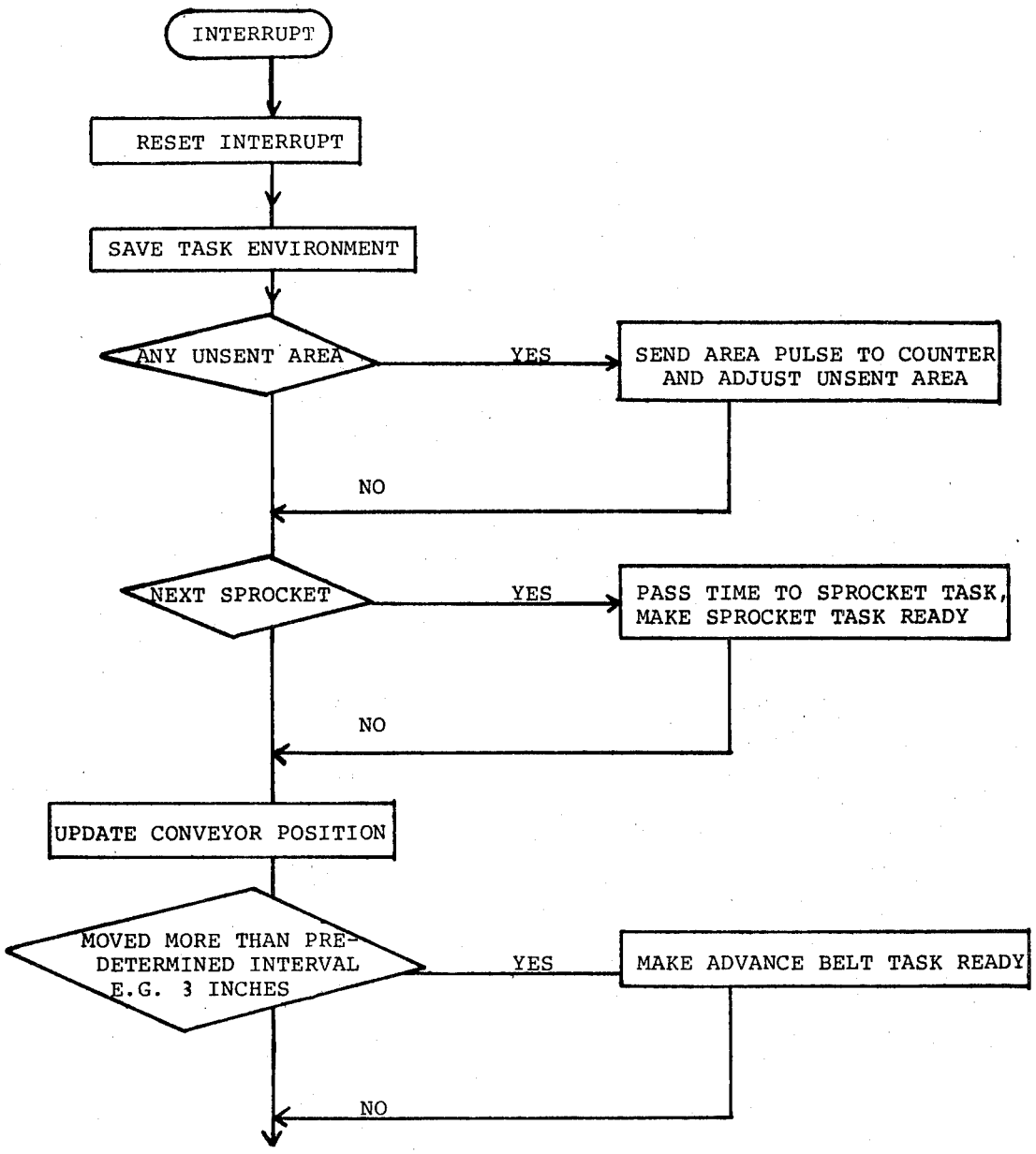
FIGS. 13(A and B) through 26 illustrate a flow chart of a program stored in EPROM memory in the CPU and executed by the CPU.
Figure 13:
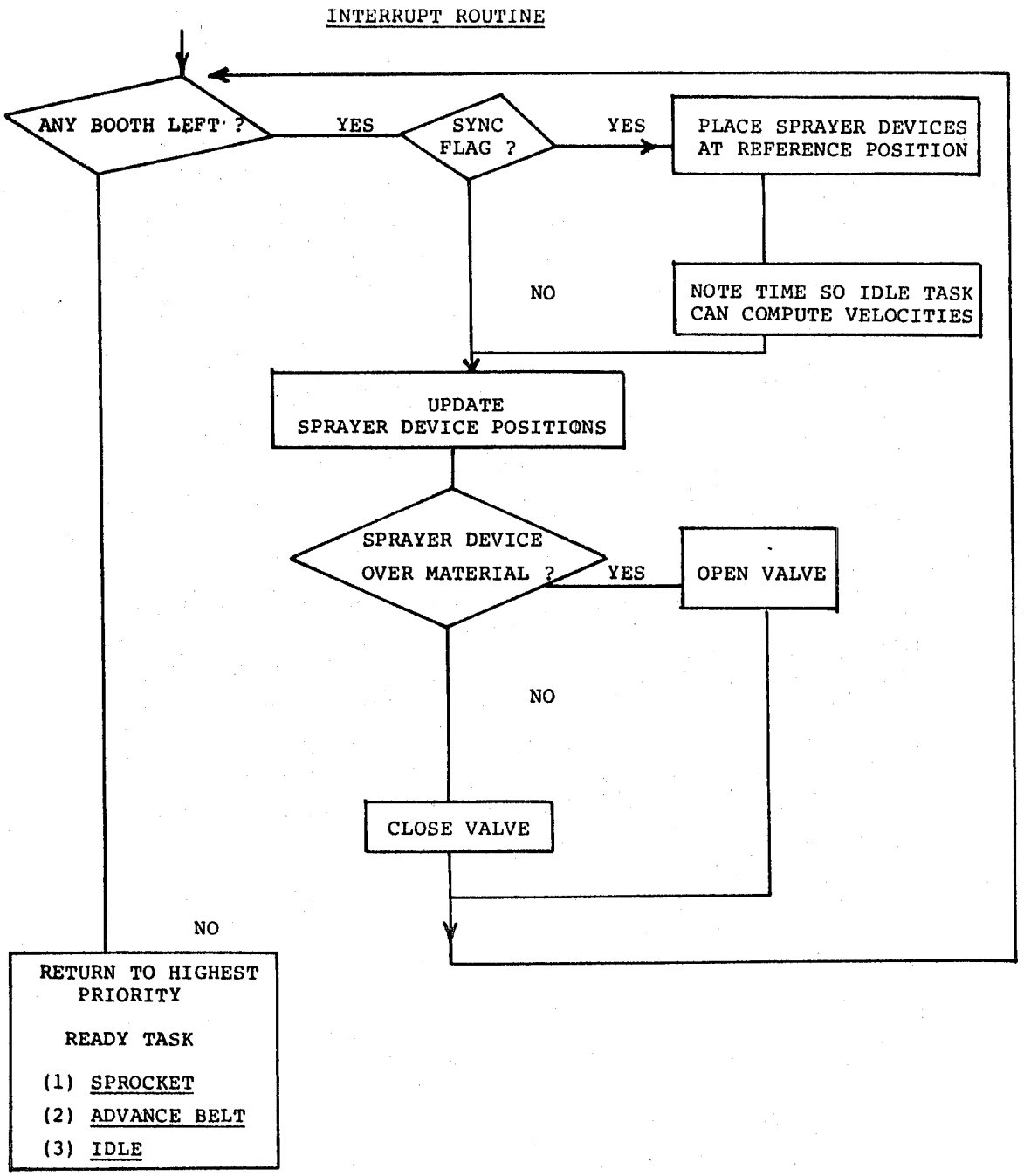
Figure 16:
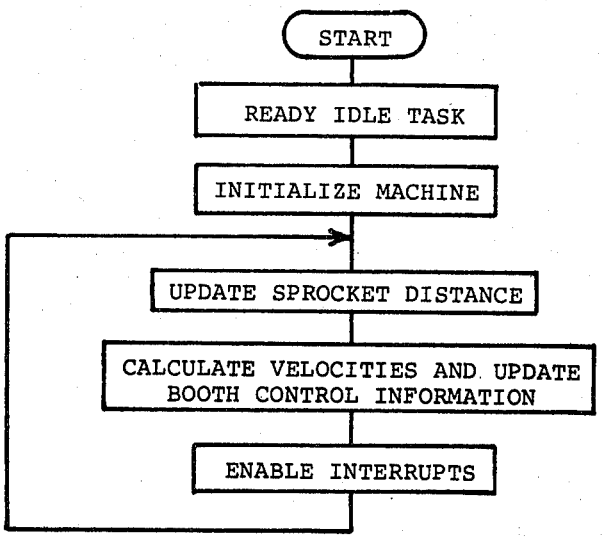

The computer unit 110 (or 210) comprises two portions: an I/O portion shown, in part, in FIG. 10 and a CPU portion shown in FIG. 11.

The I/O portion in FIG. 10 represents one-fourth of one of a plurality of I/O boards which provide input and output circuitry for the computer unit 110. Each such board has four inputs (indicated as IN#1, IN#2, IN#3, and IN#4) and four outputs (indicated as OUT#1, OUT#2, OUT#3, and OUT#4). In FIG. 10, circuitry for IN#4 and OUT#1 is shown. Referring to the particular elements in FIG. 10, an address decoder 500 is shown connected to thumbwheels S1 through S6. The thumbwheels S1 through S6 provide program settings for variables such as (a) delay time between computer command and valve response, (b) spacing between booths, (c) overspray limits, and the like. The decoder 500 selects elements, such as the thumbwheels S1 through S6, which are to be addressed by the computer unit 110. Tri-state buffers 502 and 504 connect inputs to the buss. Element 506 is a data latch which holds outgoing signals. In case an overvoltage is directed to the computer unit 110 (or 210), optical isolators 508 and 510 are provided for protection. Transistor 512 drives the output OUT#1. The I/O portion channels the above-discussed signals from the thumbwheels and various proximity switches to the computer unit 110 and from the computer unil 110 (or 210) to provide valve control signals.

The CPU portion of FIG. 11 is a 6802 microprocessor-based computer board. A computer logic element U9 performs all decision functions. Data is stored in random access memories (RAMs) indicated as U1-1-U14, while the program for controlling the valves of the sprayer devices is stored in erasable EPROMS U1-5-U18. The RAMs U11-U14 store the results of all calculations as well as information relating to the dimensions and location of a material on the conveyor. Address space of the logic element U9 is partitioned to the devices on the buss by use of address decoders U1, U5A and U5B, and U19. These decoders U1, U5A and U5B, and U19 along with control logic U6 and U8 provide all the enabling gate signals for the system. Clocking is performed by elements U2, U3, and U7. Elements U10 and U22 are buss drives and are used to send signals to the I/O cards.

The various circuit boards are joined together by a backplane board shown in FIG. 12. This board serves as a means to join all the circuit cards to each other, and to the various peripheral devices on the spraying machine, which includes the various sensors, proximity switches, sprayer devices, means for moving the sprayer devices, and associated elements. The circuit cards plug into edge connectors labeled J20-26. Terminal strips with screw hold downs are used to connect to the machine. These strips are labeled J12-16. The central processing board (CPU), the brain of the system, plugs into connector J21 on the backplane. The I/O boards plug into J22-J26 on the backplane, and communicate with the machine through terminal strips J12-J16, respectively. The I/O board in slot #22 is used to control the optical sensors and the sprocket sensing proximity switch. The I/O boards placed in positions 23-26 each control one spray booth, with J23 (and terminal strip J13) used for the first booth and so on.

B. Program Flowchart

The area of material detected is calculated and sent to the INTERRUPT routine (FIG. 12) for transmission to an area counter display (not shown). The new material location information is entered into a buffer which contains the location data for all material on the conveyor. Finally the position information for each spray booth sprayer device therein is updated to determine before which sprayer devices material is passing.

Figure 14:
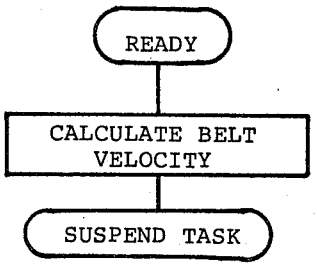

The INTERRUPT routine is called every 4 milliseconds. It first clears the interrupt and saved program environment of the task that has been interrupted. If any area information is waiting for the area display it is sent. The routine then checks for a sprocket tooth. If one is found, the time since the previous tooth was detected is passed to the SPROCKET task (FIG. 14) and the SPROCKET task is flagged as READY for execution. The conveyor position is then updated based on the conveyor velocity. Every three inches the ADVANCE BELT task (FIG. 15) is activated.

Each spray booth is then updated. First a check is made for synchronization flags. if a flag is detected the sprayer device position is set to the position for that synchronization flag. The time at that flag is noted for the IDLE task to use in calculating sprayer device velocities. The sprayer device positions are then updated and each sprayer device is left "on" if over material on the conveyor or turned "off" if not over material to be sprayed.

After all booths have been processed, control is returned to highest priority READY task. The SPROCKET task has the highest priority, the ADVANCE BELT task is second. The IDLE task is executed only when neither of the other tasks is READY to run.

Figure 15:
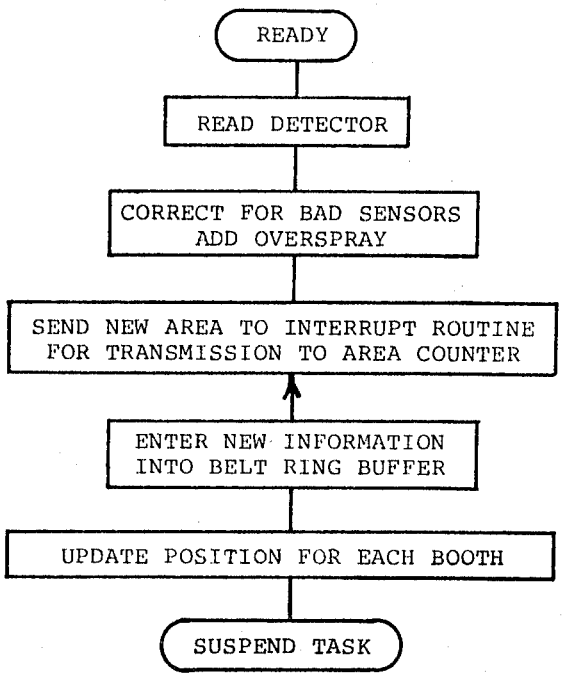

The spray control program has four main sections. The first section performs power on initialization and performs the least time critical INITIALIZATION AND IDLE tasks (FIG. 15). The SPROCKET task calculates the conveyor speed each time a sprocket tooth is sensed. The ADVANCE BELT task reads the optical detector and maintains the information on the location of material on the conveyor. The INTERRUPT routine checks for sprocket teeth, maintains time information, controls the spray guns, and controls the other tasks.

When power is applied to the computer the initialization code sets appropriate values for each machine parameter and prepares the program for execution. The IDLE portion of this program section is then executed once before any interrupts are allowed. After calculating initial timing estimates and distances for each booth, interrupts are enabled. The IDLE task continues to run at a low priority to update control parameters as necessary.

The SPROCKET task is enabled each time a tooth is detected on the conveyor drive sprocket. The time between teeth and the distance between teeth are used to calculate the conveyor speed for use in predicting conveyor position with time.

The ADVANCE BELT task is enabled each time the conveyor advances three inches. The optical sensors are read to determine the position of material on the conveyor. This information is processed to eliminate false readings from bad sensors. The apparent size of the material is extended slightly in all directions to provide overspray to assure full coverage of the material when sprayed.

In operation the SPROCKET task is activated when a tooth on the conveyor sprocket 112 is detected. This task reads the present time and subtracts the time of the last sprocket tooth detection from it. This time is divided into the sprocket distance which is settable by Sprocket Pitch Thumbwheels. Conveyor velocity is thus determined. Interrupts in this system occur on regular time intervals of once every 4 msec. Time is generated by counting interrupts. The time base is therefore 4 milliseconds. Conveyor velocity is therefore motion, in inches, per interrupt. Or, more specifically, each time the INTERRUPT ROUTINE is performed, the conveyor position is advanced by the amount calculated by the SPROCKET task. Every time three inches has been traveled the ADVANCE BELT task is called. This task calls for an optical detection reading "RDDET". This information is processed to detect the edges of the material. This is done by checking for the last occurrence of two out of three sensors on each end of the detector 104 that are blocked (not reading light). This technique allows a defective or dirty detector element to be discounted. This information which is the width and location of the material is stored in memory in the bottom location of a ring buffer (not shown). Data in the appropriate number of locations in the bottom of the ring buffer are changed to distort the turn on and turn off location to account for the droop of the arc of a one arm bandit spray machine as shown in FIG. 1. The ring buffer is then advanced to correspond to the advance of the conveyor. The ring buffer is a block of RAM locations with a pointer that indicates the next location to be loaded (see FIG. 11). When this location is loaded, the pointer is indexed to point to the next location. Each spray machine has a number associated with it which corresponds to (1) the distance (in inches) from the optical detector 114 to such machine multiplied by (2) the number of memory locations allocated to each inch of conveyor travel. This number is added to the base pointer to compute the location of the present relevent information for the corresponding spray machine. If either the base address (start value) or any spray machine location pointer exceeds the size of the ring buffer, a quantity equal to the number of total memory locations in the buffer is subtracted from it. This module count causes the memory to be addressed in a ring or cyclical manner.

Output from the optical detector 114 is addressed serially. To accomplish this, first a reset pulse is sent by the CPU to insure that the detector 114 is synchronized and ready. The CPU then transmits a string of clock pulses. Every time a clock pulse is received by the optical detector 114, a data signal is presented back to the CPU. This signal represents the state of elements in the detector 114 successively. Each time a data signal is received by the CPU it is processed to determine the location of the edges of the material. When the edge locations are determined, the results are past back to the ADVANCE BELT. The read detector routine RDDET is called.

The motion of the spray machine is tracked by the DREAD routine. When a flag is detected, the duration of detection is measured. The duration of each of the last six flags is compared to this reading. If this flag is longer than the previous five detected flags, then this flag is the longer (sync) flag. Each flag is identified by its occurrence and is related in time to the longer sync flag. For each flag that is detected a velocity calculation is done as follows: It is necessary to anticipate the occurrence of a flag detection so that each sprayer device can be turned on or off in advance to accomplish the delay function. As previously suggested, an active sprayable region of the conveyor comprises four subregions: left to center traveling to the right, center to right traveling to the right, right to center traveling to the left, and center to left traveling to the left. These four regions have equal lengths, namely the width of active region as set on the optical detector 114 width thumbwheel, divided by two. The time period that the arm spends in each subregion is defined as the time between the occurrence of the flag that begins the subregion to the occurrence of the flag that ends the subregion.

The time of occurrence of each flag as corrected to account for delay is determined by using the flag on the opposite side of the cam (three flags away) as a reference of a complete cycle in the following algorithm: Time of flag minus Time of flag one cycle ago minus the required delay time plus the time of occurrence of this flag during the last cycle. The velocity of the spray arm in each subregion is then determined by taking the subregion distance and dividing by the time interval between the occurrence of the flags that start and end the respective region. This velocity is used to determine the position of the spray arm at the occurrence of each interrupt.

The position of the material M is read from the ring buffer location corresponding to the location of each sprayer device S. The position of the left and right edge of the material is adjusted to provide for the correct amount of overspray as set on the overspray thumbwheel. When the position of a sprayer device S matches the position of the edge the region to be sprayed a command to turn on or off, as appropriate is transmitted to the corresponding control valve.

C. Program Listing

A program listing for the "one arm bandit" embodiment, which listing is based on the Flowchart discussed above in Section B, follows as Table I.

3. Alternative Embodiments

Other improvements, modifications and embodiments will become apparent to one of ordinary skill in the art upon review of this disclosure. Such improvements, modifications and embodiments are considered to be within the scope of this invention as defined by the following claims. For example, although improving on prior systems by preferably employing normally open valves, forms of the invention may be practiced with normally closed valves as well.

We claim:

1. Apparatus for spraying at least one substance onto a material carried on a conveyor, the apparatus comprising:

a plurality of spray booths spaced at intervals and in series along the length of the conveyor, each spray booth comprising at least one sprayer device and each sprayer device having a valve for selectively permitting or inhibiting the spraying of one substance therefrom;

means for moving each sprayer device in each spray booth relative to the conveyor;

a plurality of sensors, each sensor detecting when material on the conveyor is presented to each such sensor;

means, receiving input from the moving means, for detecting the position of each sprayer device;

means for detecting the movement of the conveyor;

a single computer unit;

a first means, including the means for detecting and the computer unit, for determining the speed of the conveyor;

a second means including the plurality of sensor and the computer unit for deriving information relating to the location of material on the conveyor and storing the material location information; the means for moving being responsive to information derived by the second means and including means for (a) positioning the sprayer device at each spray booth at a reference position, and (b) updating the position of the sprayer devices; and means for determining which, if any, sprayer devices are not properly positioned for spraying onto material on the conveyor;

wherein the valve of each sprayer device comprises a normally open valve, the computer unit providing only signals to close a valve when spray from a corresponding device is to be inhibited.

2. Apparatus as in claim 1 wherein the computer unit communicates a valve close signal to a valve when the computer unit, in response to information derived from signals provided thereto by the first, second, and third means, determines that spray from a corresponding sprayer device extends beyond a predetermined distance from the edge of the material on the conveyor.

3. Apparatus as in claim 1 or 2 wherein the conveyor movement detecting means comprises:

a toothed sprocket which advances synchronously with the conveyor; and a proximity switch which changes state each time a sprocket tooth passes a reference position.

4. Apparatus as in claim 3 further comprising:

means, including the conveyor movement detecting means, and the second means for (a) updating conveyor movement, and (b) determining the velocity of each sprayer device.

5. Apparatus for spraying at least one substance onto a material carried on a conveyor, the apparatus comprising:

a plurality of spray booths spaced at intervals and in series along the length of the conveyor, each spray booth comprising at least one sprayer device and each sprayer device having a valve for selectively permitting or inhibiting the spraying of one substance therefrom;

means for moving each sprayer device in each spray booth relative to the conveyor;

a plurality of sensors, each sensor detecting when material on the conveyor is presented to each such sensor;

means, receiving input from the moving means, for detecting the position of each sprayer device;

means for detecting the movement of the conveyor;

a single computer unit;

a first means, including the means for detecting and the computer unit, for determining the speed of the conveyor; and a second means, including the plurality of sensor and the computer unit, for deriving information relating to the location of material on the conveyor and storing the material location information; the means for moving being responsive to information derived by the second means and including means for (a) positioning the sprayer devices at each spray booth at a reference position, (b) updating the position of the sprayer devices; and means for determining which, if any, sprayer devices are not properly positioned for spraying onto material on the conveyor;

wherein the sprayer devices of at least one spray booth comprise a rotating sprayer arrangement each such rotating arrangement including a pipe having arms extending radially outward therefrom, the sprayer devices being attached to the arms, each sprayer device in the rotating sprayer arrangement being moved in a circular path by the moving means; and wherein the apparatus further comprises a rotary transformer coupling which comprises (a) a first circular coil connected to receive signals provided by the computer unit and (b) a second circular coil sharing a common axis with and being space apart from the first circular coil, the second circular coil receiving input from the first circular coil and carrying respective the input to each valve in the rotating sprayer arrangement, the second circular coil being rotatable relative to the first circular coil about the common axis.

6. Apparatus as in claim 1 wherein the valves comprise normally open valves and the signals communicated to the valves selectively indicate which valves are to be closed.

7. Apparatus as in claim 1 wherein the first circular coil and the second circular coil have substantially the same average radii.

8. Apparatus as in claim 1 wherein the rotary transformer coupling further comprises a shell containing the second circular coil, the pipe being coupled to the shell of the second circular coil, such that the pipe, the shell, and the second circular coil are rotatable together relative to the first circular coil.

9. Apparatus as in claim 1 further comprising:

means, interposed between the computer unit and the first circular coil, for encoding the output of the computer unit with a distinct code for each valve.

10. Apparatus as in claim 9 further comprising:

a voltage-to-frequency converter interposed between the encoding means and the first circular coil.

11. Apparatus as in claim 10 further comprising:

means, interposed between the second circular coil and the valves, for demodulating the signal communicated to the second circular coil.

12. Apparatus as in claim 11 further comprising:

an a.c. power source; and means for combining the output of the power source with the output of the voltage-to-frequency converter, the output of the combining means entering the first circular coil and being communicated to the second circular coil.

13. Apparatus for spraying at least one substance onto a material carried on a conveyor, the apparatus comprising:

a plurality of spray booths spaced at intervals and in series along the length of the conveyor, each spray booth comprising at least one sprayer device and each sprayer device having a valve for selectively permitting or inhibiting the spraying of one substance therefrom;

means for moving each sprayer device in each spray booth relative to the conveyor;

a plurality of sensors, each sensor detecting when material on the conveyor is presented to each such sensor;

means, receiving input from the moving means, for detecting the position of each sprayer device;

means for detecting the movement of the conveyor;

a single computer unit;

a first means, including the means for detecting and the computer unit, for determining the speed of the conveyor; and a second means, including the plurality of sensor and the computer means, for deriving information relating to the location of material on the conveyor and storing the material location information; the means for moving being responsive to information derived by the second means and including means for (a) positioning the sprayer devices at each spray booth at a reference position, (b) updating the position of the sprayer devices; and wherein the sprayer device of at least one spray booth comprise a one arm bandit arrangement each such one arm bandit arrangement comprising:

an arm having a first end and a second end and a pivot therebetween, the sprayer devices being disposed along the arm between the pivot and and the second end;

a cam wheel having (a) an axis about which the cam wheel rotates and (b) a plurality of flags disposed at a distance radially outward from the axis, one of the flags being a distinctive flag;

a control rod (a) one end of which is rotatably coupled to a point to the cam wheel, the point being at a radial distance from the axis of the cam wheel and (b) the other end of the control rod is rotatably coupled to the first end of the arm; and means for detecting one flag after another as the cam wheel rotates, the flag detecting output being provided to the computer unit, the detection of the distinctive flag providing synchronization information relating to arm position.

14. Apparatus as in claim 13 further comprising:

means for selectively setting an overlap limit; and means for closing the valve of a respective sprayer device when the sprayer device moves beyond the overlap limit.

15. Apparatus as in claim 13 further comprising:

means, including the computer unit, for compensating for delay between the time when a signal for inhibiting spraying is communicated and the time when the valve for the corresponding sprayer device is closed.

16. Apparatus as in claim 13 further comprising:

means, including the computer unit, for compensating for droop in the path of the arm due to the non-rectilinear path of the second end of the arm.

17. Apparatus as in claim 13 further comprising:

means for selecting input values corresponding to the distances between spray booths and the distance between the plurality of sensors and the spray booths; and means, including the computer unit, for adjusting the timing of valve close signals communicated by the computer unit, the means for adjusting being connected to receive the input values from the means for selecting.

18. In apparatus for spraying at least one substance onto a material from at least one sprayer device, each sprayer device moving in a circular path about a common axis and being selectively permitted and inhibited from spraying by a respective valve, a rotary transformer coupling for communicating signals from a stationary computer unit to the valve of each sprayer device, the rotary coupling comprising:

(a) a first circular coil connected to receive signals provided by the computer unit and (b) a second circular coil sharing a common axis with it being spaced apart from the first circular coil, the second circular coil receiving input from the first circular coil and providing the input to each valve, the second circular coil being rotatable relative to the first circular coil about the common axis.

19. Apparatus as in claim 16 or 18 wherein the valves are normally open and the signals provided to the valves selectively indicated which valves are to be closed.

20. Apparatus as in claim 18 wherein the first circular coil and the second circular coil have substantially the same average radii.

21. Apparatus as in claim 16 or 18 wherein the rotary transformer coupling further comprises a first shell containing the first circular coil and a second shell containing the second circular coil; and means for mechanically rotatably coupling the first shell and the second shell such that the second circular coil is rotatable relative to the first circular coil.

22. Apparatus as in claim 18 further comprising:

means interposed between the computer unit and the first circular coil, for encoding the output of the computer unit with a distinct voltage-related code for each valve.

23. Apparatus as in claim 22 further comprising:

a voltage-to-frequency converter interposed between the encoding means and the first circular coil.

24. Apparatus as in claim 23 further comprising:

means, interposed between the second circular coil and the valves, for demodulating the signal communicated to the second circular coil.

25. Apparatus as in claim 24 further comprising:

an a.c. power source;

means for combining the output of the power source with the output of the voltage-to-frequency converter, the output of the combining means entering the first circular coil and being communicated to the second circular coil.

26. Apparatus as in claim 25 wherein the combining means comprises:

a coupling capacitor between the voltage-to-frequency converter and (a) the first circular coil and (b) the power source; and a blocking inductor between the power source and (a) the first circular coil and (b) the computer unit.

27. A method for spraying at least one finishing substance onto a material carried on a conveyor along which at least one spray booth is positioned, each spray booth having at least one sprayer device associated therewith, each sprayer device being movable in cyclical fashion relative to the conveyor and having a valve for selectively permitting or inhibiting the dispensing of a substance therefrom, the method comprising:

positioning sensors across the conveyor and before the first spray booth along the conveyor;

detecting when material passes before each such sensor;

detecting the respective position of each sprayer device;

measuring the movement of the conveyor; and executing a spray control operation comprising the steps of:

(a) determining the speed of the conveyor based on the conveyor movement measurements;

(b) determining the location and size of material on the conveyor based on the detection of material by the sensors;

(c) updating the position of each sprayer device; and (d) determining which, if any, sprayer device is not properly positioned for spraying a substance onto material on the conveyor; and maintaining each valve in a normally open state; and wherein the operation executing step further comprises the step of:

(e) generating a valve close signal to a valve when the corresponding sprayer device is determined to be not properly positioned for spraying.

28. A method as in claim 27 wherein the operation executing step further comprises the step of:

synchronizing the position of each sprayer device prior to each cycle of movement of the sprayer device.

29. A method as in claim 27 comprising the further step of:

controlling overlap spraying including the step of:

controlling the cycle over which each sprayer device moves relative to the determined speed of the conveyor.

30. A method for spraying at least one substance onto a material carried on a conveyor, the method comprising the steps of:

directing each of a plurality of sprayer devices toward the material-carrying surface of the conveyor;

detecting the presence of material at each of a plurality of locations along the conveyor by respective sensors;

detecting the position of each sprayer device;

determining the speed of the conveyor;

deriving information relating to the location of material on the conveyor, the position of each sprayer device, and the conveyor speed;

determining in a computer from the derived information which sprayer devices are not properly positioned for spraying; and maintaining a spray valve for each sprayer device in a normally open condition to permit spraying, the spray valve for each sprayer device being closed in response to a signal from the computer indicating that said each sprayer device is not properly positioned for spraying.

31. A method for spraying as in claim 30 further comprising the step of:

moving each sprayer device relative to the conveyor.

32. A method for spraying as in claim 31 further comprising the step of:

coupling a plurality of sprayer devices together at a spray booth.

33. A method for spraying as in claim 32 further comprising the steps of:

moving the sprayer devices at said spray booth by a reference position as the sprayer devices relative to move; relative to the conveyor; and updating the positions of the sprayer devices in said spray booth as the sprayer devices move;

the position information used in the determination of the proper position for spraying for said each sprayer device for being the updated position of said each sprayer device.

34. A method for spraying as in claim 32 further comprising the step of:

arranging the sprayer devices at said spray booth so that all coupled sprayer devices are spaced from and rotatable about a common axis.

35. A method for spraying as in claim 34 further comprising the step of:

providing a first coil for receiving signals from the computer;

directing signals at the first coil to a second coil;

coupling the second coil to the respective sprayer devices, signals on the second coil communicating the closing of valves for respective sprayer devices.

36. A method for spraying as in claim 35 further comprising the step of:

encoding the signals directed to the second coil with a distinct code for each sprayer device.

37. A method for spraying at least one substance onto a material carried on a conveyor, the method comprising the steps of:

directing each of a plurality of sprayer devices toward the material-carrying surface of the conveyor;

detecting the presence of material at each of a plurality of locations along the conveyor by respective sensors;

detecting the position of each sprayer device;

determining the speed of the conveyor;

deriving information relating to the location of material on the conveyor, the position of each sprayer device, and the conveyor speed;

determining in a computer from the derived information which sprayer devices are not properly positioned for spraying;

coupling a plurality of sprayer devices together at a sprayer booth and arranging the sprayer devices at said sprayer booth so that all coupled sprayer devices are spaced from and rotatable about a common axis; and spraying substance onto material from a sprayer device determined to be properly positioned for spraying onto the material and disabling the spraying of substance onto material from a sprayer device determined to be improperly positioned for spraying onto the material.

38. A method for spraying as in claim 37 further comprising the step of:

providing a first coil for receiving signals from the computer;

directing signals received at the first coil to a second coil;

coupling the second coil to the respective sprayer devices, signals on the second coil communicating the closing of valves for respective sprayer devices.

39. A method for spraying as in claim 38 further comprising the step of:

encoding the signals directed to the second coil with a distinct code for each sprayer device.

40. A method for spraying at least one substance onto a material carried on a conveyor, the method comprising the steps of:

directing each of a plurality of sprayer devices toward the material-carrying surface of the conveyor and positioning at least some of the sprayer devices along a pivotable arm between one end of the arm and the pivot point thereof;

detecting the presence of material at each of a plurality of locations along the conveyor by respective sensors;

detecting the position of each sprayer device;

determining the speed of the conveyor;

deriving information relating to the locations of material on the conveyor the position of each sprayer device, and the conveyor;

determining in a computer from the derived information which sprayer devices are not properly positioned for spraying;

coupling the other end of the arm to a reciprocating device to effect motion of said other end of the arm transverse to the longitudinal axis of the arm and about the pivot point and maintaining the spray valve for each sprayer device in a normally open position to permit spraying, the spray valve for each sprayer device being closed in response to a signal from the computer that said each sprayer device is not properly positioned for spraying.

41. A method for spraying as in claim 40 wherein the coupling step comprises the steps of:

pivotally connecting a first end of a control rod to said other end of the arm and pivotally connecting the second end of the control rod to an eccentric point on a rotatable cam wheel.

42. A method for spraying as in claim 41 further comprising the step of:

applying at least one distinctive flag to the cam wheel at a distance from the rotational axis thereof; and detecting each flag with a stationary sensor as the cam wheel rotates, the flag detection indicating the position of the arm relative to the conveyor.

43. A method for spraying as in claim 40 wherein the spraying for each sprayer device includes the step of:

spraying beyond the edges of the material on the conveyor.

* * * * *